United States Patent [19]

Schleicher

[11] 4,208,776

[45] Jun. 24, 1980

[54] PUNCH, DIE AND ANVIL SET

[76] Inventor: Louis C. Schleicher, 1917 Marcastle Ct., Rochester, Mich. 48063

[21] Appl. No.: 931,309

[22] Filed: Aug. 7, 1978

Related U.S. Application Data

[63] Continuation of Ser. No. 826,631, Sep. 15, 1977, abandoned.

[51] Int. Cl.[2] ..... B23P 11/00

[52] U.S. Cl. ..... 29/243.5

[58] Field of Search ..... 29/243.5, 283.5, 798, 29/432.1, 509, 566, 569, 33 K, 33 M; 10/11 A; 72/326

[56] References Cited

U.S. PATENT DOCUMENTS

| | | | |
|---|---|---|---|
| 1,456,079 | 5/1923 | Stuebner | 29/432.1 |
| 3,726,000 | 4/1973 | Hafner | 29/509 |
| 4,035,901 | 7/1977 | Lux et al. | 29/432.1 |
| 4,059,897 | 11/1977 | Marquis | 29/432.1 |

*Primary Examiner*—James L. Jones, Jr.
*Attorney, Agent, or Firm*—William L. Fisher

[57] ABSTRACT

Improvement in a punch, anvil and die set for spot clinching two or more materials together to form a spot clinch joint in which the anvil is arranged inside of the die and the punch and die move toward and away from each other and a lancing operation occurs on a workpart followed by a swaging operation in which the die spreads apart to accommodate the radial enlargement of the material of the workpart being swaged, the improvement comprising the die having a rigid base having an aperture therein, the anvil disposed in the aperture, an arrangement for adjusting the axial position of the anvil relative to the die to accommodate different thicknesses of workparts, the die having resilient fingers which upstand from the base, the die fingers, in themselves, providing both the strength to support the workpart to effect the lancing operation and the resiliency to separate from the front end of the anvil during the swaging operation, the die and anvil normally engaged at both their front and rear ends and spaced from each other between the ends, the spaces extending axially between the die fingers and the anvil and serving to prevent foreign matter from hindering return of the die fingers to their closed position following the swaging operation.

6 Claims, 11 Drawing Figures

PUNCH, DIE AND ANVIL SET

This application is a continuation of Ser. No. 826,631, Sept. 15, 1977, abandoned.

My invention relates to improvements in a punch, die and anvil set for spot clinching two or more materials together to form a spot clinch joint.

It is known to construct such a punch, die and anvil set in which the anvil is inside the die amd the punch and die are moved toward and away from each other to effect first a lancing operation and then a swaging operation on a workpart and in which the die spreads apart to accommodate the radial enlargement of the workpart being swaged. However, such punch, die and anvil sets are plagued by malfunctioning problems from the entrance of foreign matter between the die and anvil which prevents the die from returning to its closed position following the swaging operation.

The principal object of my invention is to provide improvements in the construction of such punch, die and anvil set so as to prevent foreign matter from hindering return of the separated parts of the die to their closed position following the swaging operation.

The foregoing object of my invention and the advantages thereof will become apparent during the course of the following description, taken in conjunction with the accompanying drawings, in which.

Figure 1:
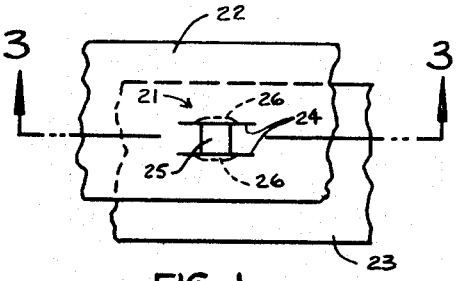
FIGS. 1 and 2 are, respectively, top and bottom plan views of two metal sheets fastened together by a spot clinch joint formed together by lancing and swaging using the punch, die and anvil set embodying my invention.
Figure 2:
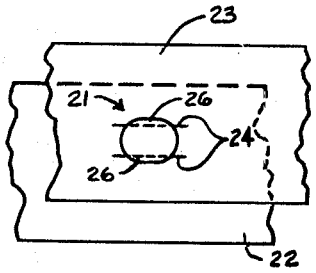
Figure 3:
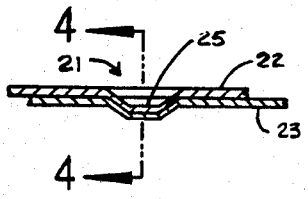
FIG. 3 is a longitudinal sectional view of the structure of FIG. 1 taken along the line 3—3 thereof.
Figure 4:
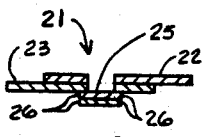
FIG. 4 is a transverse sectional view of the structure of FIG. 3 taken along the line 4—4 thereof.
Figure 11:
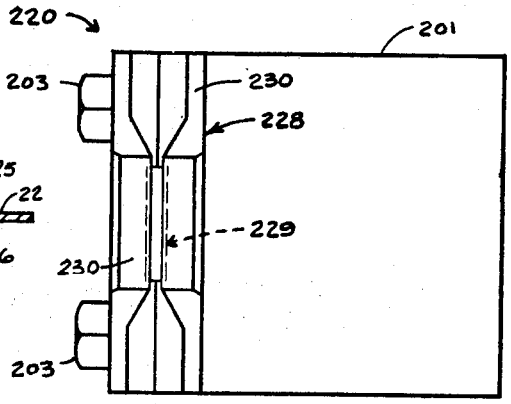
Figure 10:
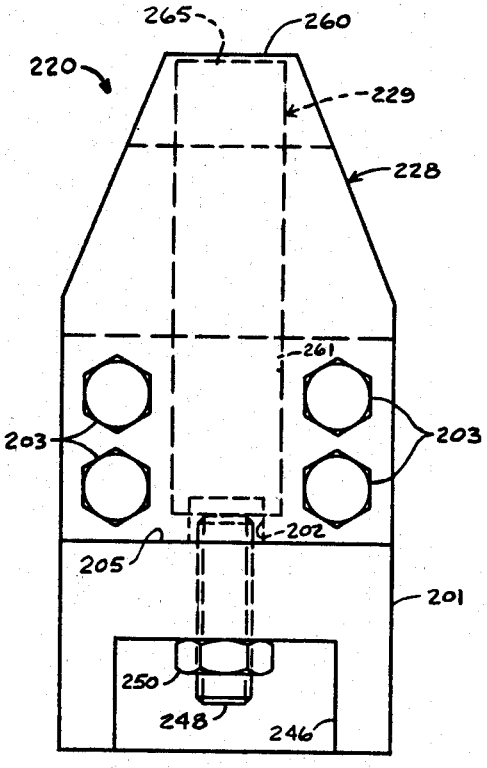
Figure 9:
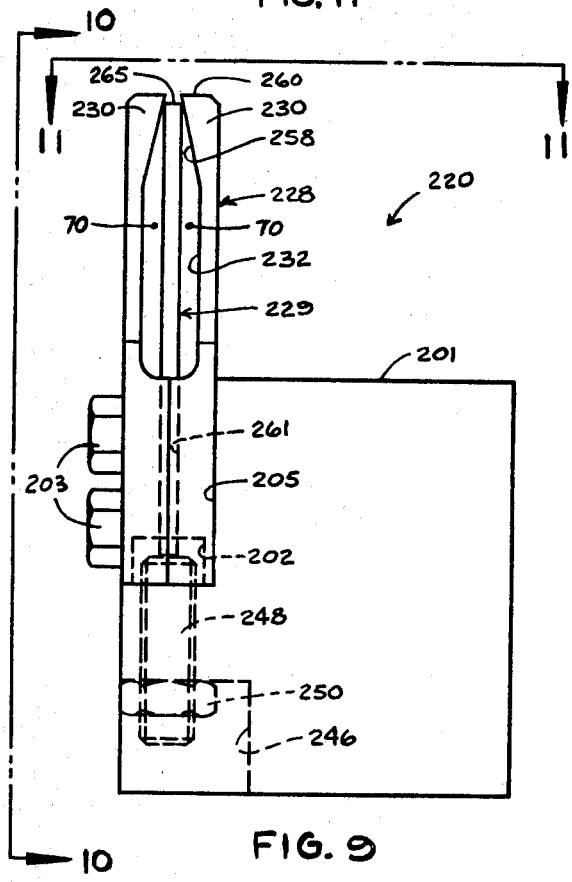
Figure 7:
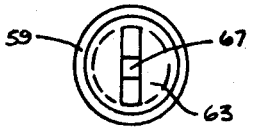
FIG. 7 is a bottom plan view of the upper part of the structure of FIG. 6 taken on the line 7—7 thereof.

FIG. 9 is a front elevational view of another embodiment of punch, die and anvil set shown in relationship with other parts forming one part of another spot clinch tool; and FIGS. 10 and 11 are respective side elevational and top views, of the structure of FIG. 9 taken on the lines 10—10 and 11—11 thereof, respectively.

Referring to the drawings in greater detail and first to FIGS. 1-8, 20 generally designates the spot clinch tool shown therein and 21 said spot clinch joint formed thereby. Said tool 20 is formed by the first-mentioned embodiment of punch, die and anvil set and other associated parts to be described. The three elements of said punch, die and anvil set are designated 27,28 and 29, respectively. The punch 27 has an operative front end 67 and a flange 31 at its rear end. In this instance, the die 28 is a one-piece cylindrical member having an operative front end 60 and a rigid base at its rear end. A bore 61 is provided in said die 28. A flange 38 is formed at the rearmost portion of said base. In this instance, a pair of fingers 30 upstand from said base. The die fingers 30 are formed by slots 32 which are enlarged, as at 34, at their rear or bottom ends. At the rear end of the die 28 the bore 61 therein is enlarged, as at 54, to form a spring housing. The die fingers 30, in themselves, provide both the strength to support the workpart to effect the lancing operation to be described and the resiliency to separate from the front end of the anvil during the swaging operation to be described. The anvil 29 has an operative front end 65 and a flange 33 at its rear end. The anvil 29 is disposed in the bore 61 and slideable relative to the die 28. The front end of the anvil 29 is cut-away, as at 69, for purposes which will be described. The cutaway portion 69 is spaced from the inside wall of the fingers 30 and these spaces are designated 70. Said fingers 30 are notched, as at 36, at their lower ends and the amount of resiliency thereof can be predetermined by such notching.

In this instance, the parts associated with said punch, die and anvil set to form said spot clinch tool 20 consist of a stripper part 59 and base members 41,43 and 49 bolted together, as at 55, for the punch 27. For the die 28 and anvil 29, said parts consist of a compression spring 52 operative upon said anvil 29 and base members 40 and 42 bolted together, as at 44, an ajusting screw 48 and lock nut 50. The punch 27 is solidly bottomed against the base member 41 and has its rear portion accommodated in cavities 45 and 47 in the base member 43. The stripper part 59, which has an operative front end 63, is slideably disposed in cavities 51 and 53 in said base member 49 and encircles the cylindrical portion of the punch 27. The cavity 51 forms a spring housing for the spring 57 which encircles the cylindrical portion of the punch 27 behind the stripper part 59. The die 28 is solidly bottomed against the base member 40 and has its rear portion accommodated in cavities 71 and 72 in the base member 42. The base member 40 is provided with a threaded aperture 73 and a counterbore 46 which accommodate the adjusting screw 48 and the lock nut 50, respectively. The front end of the adjusting screw 48 projects into the cavities 71 and 72 and serves as a solid bottom for the anvil 29 during the swaging operation to be described. The spring 52 encircles the front end of the adjusting screw 48 and normally maintains the anvil 29 in its extended position. The space between the front end of the adjusting screw 48 and the rear end of the anvil 29 is designated 56. By virtue of the arrangement described of the adjusting screw 48 and lock nut 50, said space 56 is adjustable to accommodate different thicknesses of workparts. As mentioned, the die 28 and the anvil 29 are normally engaged at both their front and rear ends and spaced from each other between said ends, as at 70. These spaces 70 extend axially between the die fingers 30 and the cut-away portion 69 of the anvil 29 and serve to prevent foreign matter from hindering return of the die fingers 31 to their closed position following the swaging operation to be described. The die 28 is provided with opposing faces, as at 58, and edges of the anvil 29 are disposed between and engaged against said opposing faces 58 in the closed position of the die 28. These opposing faces 58 are of limited length, i.e., of the order of the width of the anvil 29 to enhance the clean condition maintained between the die 28 and the anvil 29. To still further ensure such clean condition said opposing faces 58 are each disposed at an angle to the axis of the die 58, whereby only line contact is made between said opposing faces 58 and said edges of the anvil 29.

Figure 8:
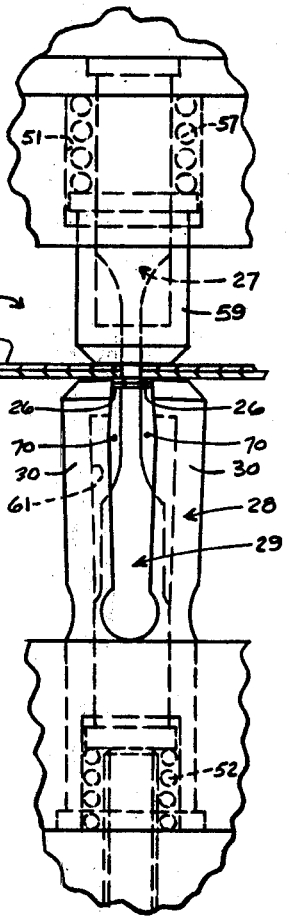
FIG. 8 is a fragmentary view similar to FIG. 6 with the spot clinch tool shown in closed position.

In operation of the tool 20, the base members 40 and 41 are fastened in suitable apparatus (not shown) capable of relatively moving the punch 27, on the one hand, and the die 28 and anvil 29, on the other, toward and away from each other to effect a closing and opening action for said tool 20. The movement of elements toward each other during the closing action of said tool 20 must be with sufficient force to effect, first a lancing operation, and then a swaging operation on the workpart. The workpart, in the form of metal sheets 22 and 23, in this instance, is either fed into the gap between the elements and laid upon the operative end of either the punch 27 or the die 28 or said sheets 22 and 23 are held stationary and said tool 20 is moved into position in respect thereto to form said joint 21 where desired. During a first part of the closing action of the tool 20 the punch and the die 28 are moved relative to each other until they engage the workpart and during a second part thereof they continue moving under force sufficient to lance the sheets 22 and 23 through, forming a depression 25 in said joint 21. During this lancing operation, the anvil 29 engages the workpart and retracts relative to the die against the urging of the spring 52 and bottoms against the adjusting screw 48. The stripper part 59 also engages the workpart and is forced to retract relative to the punch 27 against the urging of the spring 57. During a third and final part of said closing action, as shown in FIG. 8, the punch 27 and anvil 29 relatively move still further toward each other and operate upon the lanced portions of the sheets 22 and 23 to swage them. During this swaging step the lanced portion of the sheets 22 and 23 are enlarged or expulsed, as at 26, to a greater dimension than the original depression 25 so that the joint 21 is completely and permanently locked and the die fingers 30 spread apart to allow for the radial enlargement which occurs. Upon completion of the swaging operation the tool 20 commences its opening action in which the punch 27 and the anvil 29 relatively retract in respect to each other. Retraction of the punch 27 from the anvil 29 actuates the spring 52 which pushes upon the anvil 29 to move it to its extended position. The operative end 65 of the anvil 29 then pushes upon a side of the workpart to expel the latter from between opposing faces 58 of the die 28. As the operative end 67 of the punch 27 retracts from the anvil 29 the stripper part 59 is held against and pushes upon a side of the workpart to expel the latter from the operative end 67 of the punch 27. During the repeated opening and closing action of the tool 20, the spaces 70 between the die fingers 30 and the anvil 29 insure that foreign matter will fall away from and cannot lodge between the die 28 and anvil 29. By virtue of this arrangement the die fingers 30 will always precisely return to their closed position which is essential to insure reliability and freedom from malfunctioning in high production metalworking. Also the die fingers 30, in being each integrally formed with at least a part of the solid base, have the advantage of inherent resiliency and do not have the disadvantages of pivot pins and springs. In lieu of the two die fingers 30 shown, three or four die fingers may be provided for the die 28 in which case the spot clinch joint will have three or four sides in lieu of the two sides shown for the spot clinch joint 21.

Figure 5:
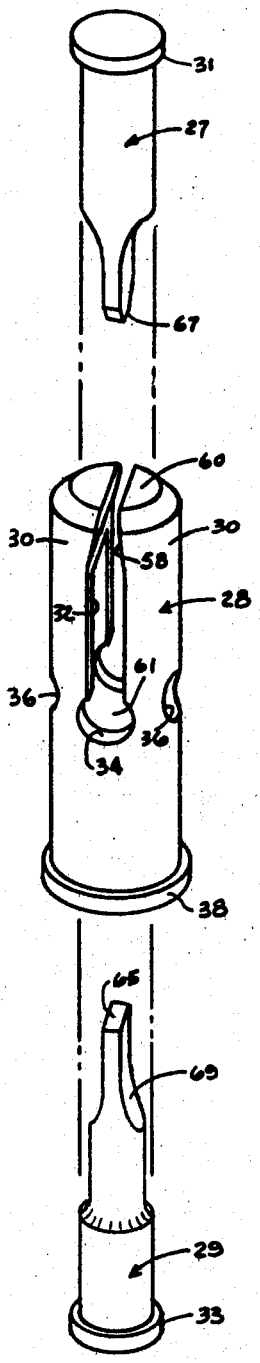
FIG. 5 is a perspective view of a punch, die and anvil set embodying my invention
Figure 6:
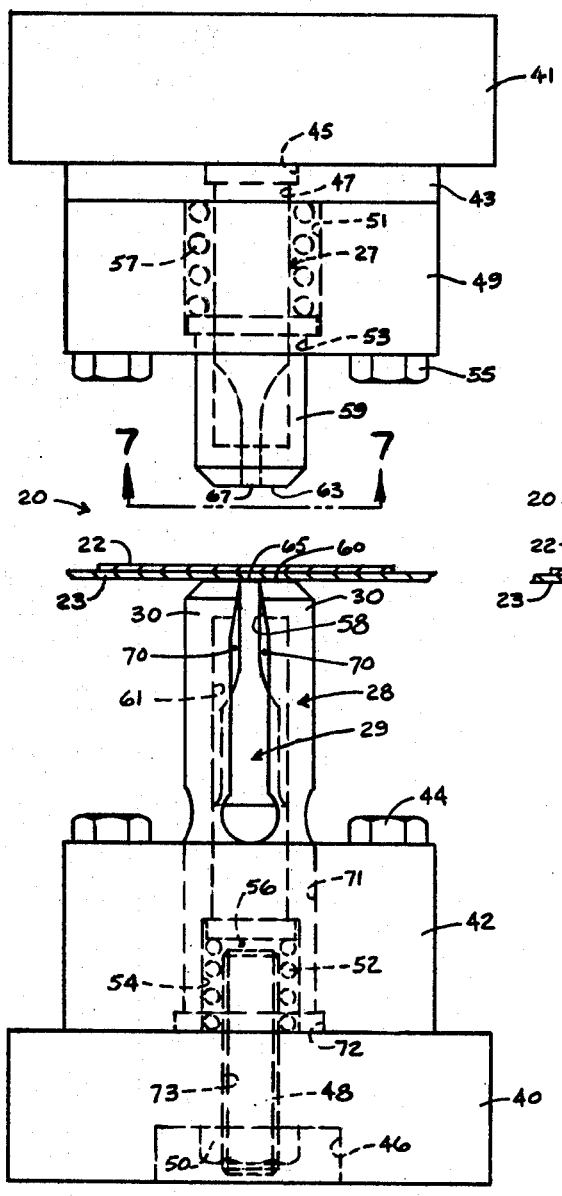
FIG. 6 is a front elevational view of said punch die and anvil set shown in relationship with other parts forming a spot clinch tool shown in open position.

Referring now to FIGS. 9–11, 220 generally designates the spot clinch tool shown therein which is formed by said other embodiment of punch, die and anvil set and other associated parts to be described. The punch 27 shown in FIG. 5 is one of the three elements of said other embodiment of punch, die and anvil set. The other two elements are the die and anvil shown in FIGS. 9–11 and designated 228 and 229, respectively. In this instance, the die 228 is formed in two pieces which are clamped solidly together at their rear ends to form a rigid base. A clearance aperture 261 is formed in said die base for slidably retaining the anvil 229. The die fingers 230 are formed by cutting away the material of the die 28 used to form the base thereof and the resiliency thereof is predetermined by the amount of such cutting. Said die fingers 230 upstand from said base and are provided with opposing faces 258 on their front ends. Said die fingers 230 are formed of bars and each has a portion having a rectangular cross-section. The opposing faces 258 are of limited length and are each disposed at an angle to the axis of the die 258, whereby only line contact is made between said opposing faces 258 and said edges of the anvil 229 as before described. At the rear end of the die 228 a cavity 202 is formed to provide a space, indicated at 256, in which the front end of the adjusting screw 248 can move to adjust the axial position of the anvil 249 relative to the die 228. The anvil 229, in this instance, is formed of a bar having a rectangular cross-section. In this instance, the parts associated with the second embodiment of punch, die and anvil set are identical to those shown in the upper half of FIG. 6 for the punch 27. For the die 228 and anvil 229, said parts consist of a base member 201 in the solid form of a block. The base member 201 has cavities 205 and 246 formed in a side thereof. The die 229 is solidly bolted in place in the cavity 205, as by bolts 203. The tool 220 thus formed has the same advantages of the tool 20 of a continuously maintained clean condition between the die and anvil. The operation of the tool 220 is the same as that of the tool 20 except that the anvil 229 does not move during said operation.

It will thus be seen that there has been provided by my invention improvements in a punch, anvil and die set in which the objects hereinabove set forth, together with many thorougly practical advantages, have been successfully achieved. While a preferred embodiment of my invention has been shown and described, it is to be understood that variations and changes may be resorted to without departing from the spirit of my invention as defined by the appended claims.

What I claim is:

1. Improvement in a punch, anvil and die set for spot clinching two or more materials together to form a spot clinch joint in which the anvil is arranged inside of the die and the punch and die move toward and away from each other and a lancing operation occurs on a workpart followed by a swaging operation in which the die spreads apart to accommodate the radial enlargement of the material of the workpart being swaged, said improvement comprising said die having a rigid base having an aperture therein, the anvil disposed in said aperture and slideable relative to the die, means for adjusting the axial position of the anvil relative to the die to accommodate different thicknesses of workparts, said die having resilient fingers which upstand from and are each integral with a portion of said base, said die fingers, in themselves, providing both the strength to support the workpart to effect said lancing operation and the resiliency to separate from the front end of the anvil during the swaging operation, the die and anvil normally engaged at both their front and rear ends and spaced from each other between said ends, said spaces extending axially between said die fingers and said anvil and being accessible to foreign matter to prevent the latter from hindering return of the die fingers to their closed position following said swaging operation.

2. Improvement as claimed in claim 1 in which the die is generally cylindrical in shape and formed of one-piece and the fingers thereof are formed by axially extending slots formed in the front end of said die and in which said spaces are formed by cut-away portions on the front end of said anvil.

3. Improvement as claimed in claim 2 in which the outer cylindrical wall of the die is notched at the lower end of each finger to predetermine the amount of resiliency thereof.

4. Improvement as claimed in claim 1 in which said spaces are formed by cut-away portions on the front end of said die.

5. Improvement as claimed in claim 1, edges of the anvil being disposed between and engaged against opposing faces of the die in the closed position thereof, said opposing faces each being disposed in a plane at an angle to the axis of the anvil, whereby only line contact is made between said opposing faces and said edge of the anvil.

6. Improvement as claimed in claim 1, said punch, anvil and die set having associated therewith double stripper means consisting of two separate mechanisms, one for the punch and the other including the anvil itself, said mechanisms operative to separate the workpart from both the die and punch following said swaging operation.

* * * * *